US008515113B2

(12) United States Patent
Rothkopf et al.

(10) Patent No.: US 8,515,113 B2
(45) Date of Patent: Aug. 20, 2013

(54) COMPOSITE MICROPHONE BOOT TO OPTIMIZE SEALING AND MECHANICAL PROPERTIES

(75) Inventors: Fletcher R. Rothkopf, Los Altos, CA (US); Phillip M. Hobson, Menlo Park, CA (US); Adam Mittleman, San Francisco, CA (US); Anna-Katrina Shedletsky, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 442 days.

(21) Appl. No.: 12/859,711

(22) Filed: Aug. 19, 2010

(65) Prior Publication Data

US 2012/0046780 A1 Feb. 23, 2012

(51) Int. Cl.
*H04R 9/08* (2006.01)

(52) U.S. Cl.
USPC ..... 381/369; 381/355

(58) Field of Classification Search
USPC ..... 381/355, 369, 375
See application file for complete search history.

(56) References Cited

U.S. PATENT DOCUMENTS

| | | | | |
|---|---|---|---|---|
| 4,074,419 | A | 2/1978 | Hanni et al. | |
| 5,045,971 | A | 9/1991 | Ono et al. | |
| 5,128,829 | A | 7/1992 | Loew | |
| 5,180,644 | A | 1/1993 | Bresin et al. | |
| 5,204,907 | A * | 4/1993 | Staple et al. | 381/91 |
| 5,468,947 | A | 11/1995 | Danielson et al. | |
| 5,568,358 | A | 10/1996 | Nelson et al. | |
| 5,737,183 | A | 4/1998 | Kobayashi et al. | |
| 5,784,256 | A | 7/1998 | Nakamura et al. | |
| 5,796,575 | A | 8/1998 | Podwalny et al. | |
| 6,038,328 | A * | 3/2000 | Hsu | 381/361 |
| 6,122,389 | A * | 9/2000 | Grosz | 381/361 |
| 6,137,890 | A | 10/2000 | Markow | |
| 6,144,368 | A | 11/2000 | Ooka et al. | |
| 6,153,834 | A | 11/2000 | Cole et al. | |
| 6,408,171 | B1 | 6/2002 | Schuelke et al. | |
| 6,427,017 | B1 | 7/2002 | Toki | |
| 6,452,811 | B1 | 9/2002 | Tracy et al. | |
| 6,536,589 | B2 | 3/2003 | Chang | |
| 6,746,797 | B2 | 6/2004 | Benson et al. | |
| 6,757,157 | B2 | 6/2004 | Lammintaus et al. | |

(Continued)

FOREIGN PATENT DOCUMENTS

| | | |
|---|---|---|
| CN | 2757458 | 2/2002 |
| CN | 1361970 | 7/2002 |

(Continued)

OTHER PUBLICATIONS

Office Action dated Oct. 25, 2010 in CN Application No. 201020179389.8.

(Continued)

*Primary Examiner* — Davetta W Goins
*Assistant Examiner* — Amir Etesam
(74) *Attorney, Agent, or Firm* — Dorsey & Whitney LLP

(57) ABSTRACT

A microphone assembly for an electronic device is described. The microphone assembly can include a microphone, a microphone boot and a printed circuit board. The microphone boot can be a composite microphone boot that is formed from multiple materials. A hardness of the each of the materials used in the microphone boot can be selected to improve sealing integrity and reduce shock transmission. In one embodiment, the composite microphone boot can be formed using a double-shot injection molding process.

22 Claims, 7 Drawing Sheets

(56) References Cited

U.S. PATENT DOCUMENTS

| | | | | |
|---|---|---|---|---|
| 6,781,824 | B2 | 8/2004 | Krieger et al. | |
| 6,819,946 | B2 | 11/2004 | Hansson | |
| 6,838,810 | B1 | 1/2005 | Bovio et al. | |
| 6,847,522 | B2 | 1/2005 | Fan et al. | |
| 6,929,879 | B2 | 8/2005 | Yamazaki | |
| 7,149,557 | B2 | 12/2006 | Chadha | |
| 7,190,802 | B2 | 3/2007 | Rains et al. | |
| 7,236,357 | B2 | 6/2007 | Chen | |
| 7,297,439 | B2 | 11/2007 | Yamazaki et al. | |
| 7,352,584 | B1 | 4/2008 | Sung | |
| 7,412,267 | B2 | 8/2008 | Eaton et al. | |
| 7,432,860 | B2 | 10/2008 | Huynh | |
| 7,515,431 | B1 | 4/2009 | Zadesky et al. | |
| 7,553,055 | B2 | 6/2009 | Liu | |
| 7,558,054 | B1 | 7/2009 | Prest et al. | |
| 7,558,057 | B1 | 7/2009 | Naksen et al. | |
| 7,558,396 | B2 | 7/2009 | Liu et al. | |
| 7,564,424 | B2 | 7/2009 | Umehara | |
| 7,583,987 | B2 | 9/2009 | Park | |
| 7,620,175 | B2 | 11/2009 | Black et al. | |
| 7,663,607 | B2 | 2/2010 | Hotelling et al. | |
| 7,668,332 | B2 | 2/2010 | Williams et al. | |
| 7,688,574 | B2 | 3/2010 | Zadesky et al. | |
| 7,697,281 | B2 | 4/2010 | Dabov et al. | |
| 8,090,132 | B2 * | 1/2012 | Tang et al. | 381/361 |
| 2002/0102870 | A1 | 8/2002 | Burns et al. | |
| 2002/0107044 | A1 | 8/2002 | Kuwata et al. | |
| 2002/0114143 | A1 | 8/2002 | Morrison et al. | |
| 2003/0003945 | A1 | 1/2003 | Saiki et al. | |
| 2003/0081392 | A1 | 5/2003 | Cady et al. | |
| 2004/0084244 | A1 | 5/2004 | Zurek et al. | |
| 2004/0203518 | A1 | 10/2004 | Zheng et al. | |
| 2005/0014537 | A1 | 1/2005 | Gammon et al. | |
| 2005/0088778 | A1 | 4/2005 | Chen et al. | |
| 2005/0095745 | A1 | 5/2005 | Sapir | |
| 2006/0067070 | A1 | 3/2006 | Otsuki | |
| 2006/0157842 | A1 | 7/2006 | Goodwin | |
| 2006/0262500 | A1 | 11/2006 | Huang et al. | |
| 2007/0058821 | A1 | 3/2007 | Welsh et al. | |
| 2007/0081303 | A1 | 4/2007 | Lam et al. | |
| 2007/0160228 | A1 | 7/2007 | Yang et al. | |
| 2008/0025547 | A1 | 1/2008 | Yun et al. | |
| 2008/0037765 | A1 | 2/2008 | Finney et al. | |
| 2008/0037770 | A1 | 2/2008 | Emmert | |
| 2008/0062660 | A1 | 3/2008 | Weber et al. | |
| 2008/0069384 | A1 | 3/2008 | Kim et al. | |
| 2008/0101026 | A1 | 5/2008 | Ali | |
| 2008/0165139 | A1 | 7/2008 | Hotelling et al. | |
| 2008/0165485 | A1 | 7/2008 | Zadesky et al. | |
| 2008/0166003 | A1 * | 7/2008 | Hankey et al. | 381/370 |
| 2008/0266774 | A1 | 10/2008 | Tracy et al. | |
| 2008/0316116 | A1 | 12/2008 | Hobson et al. | |
| 2008/0316121 | A1 | 12/2008 | Hobson et al. | |
| 2009/0015510 | A1 | 1/2009 | Nakata et al. | |
| 2009/0049773 | A1 | 2/2009 | Zadesky et al. | |
| 2009/0059485 | A1 | 3/2009 | Lynch et al. | |
| 2009/0067141 | A1 | 3/2009 | Dabov et al. | |
| 2009/0155681 | A1 | 6/2009 | Lin et al. | |
| 2009/0160712 | A1 | 6/2009 | Breiter et al. | |
| 2009/0185045 | A1 | 7/2009 | Rosenblatt | |
| 2009/0201652 | A1 | 8/2009 | Chew et al. | |
| 2009/0245564 | A1 | 10/2009 | Mittleman et al. | |
| 2009/0257189 | A1 | 10/2009 | Wang et al. | |
| 2009/0257613 | A1 | 10/2009 | Khamashta et al. | |
| 2009/0302804 | A1 | 12/2009 | Park et al. | |
| 2010/0008040 | A1 | 1/2010 | Weber et al. | |
| 2010/0073247 | A1 | 3/2010 | Arkko et al. | |

FOREIGN PATENT DOCUMENTS

| | | | |
|---|---|---|---|
| CN | 2779773 | | 5/2006 |
| CN | 1870676 | | 11/2006 |
| DE | 10252308 | | 4/2004 |
| EP | 0534290 | | 3/1993 |
| EP | 1209880 | | 2/2002 |
| EP | 1257147 | | 11/2002 |
| EP | 1441489 | | 7/2004 |
| EP | 1 732 230 | A2 | 12/2006 |
| EP | 1870956 | | 12/2007 |
| EP | 2343872 | | 7/2011 |
| GB | 2137425 | | 10/1984 |
| JP | 2003-11194 | | 4/2003 |
| JP | 2004-213498 | | 7/2004 |
| JP | 2005130156 | A | 5/2005 |
| KR | 20070047650 | A | 5/2007 |
| WO | WO 2008/152438 | | 12/2008 |
| WO | WO 2009/056143 | | 5/2009 |

OTHER PUBLICATIONS

Notice of Allowance dated Sep. 3, 2010 in U.S. Appl. No. 12/205,826.
Office Action dated Jul. 12, 2010 in U.S. Appl. No. 12/205,826.
Ho et al., "Cost Effective Integrated Housing and Printed Circuit Module for Battery Pack," ip.com Prior Art Database, Apr. 29, 2004, 6 pgs.
U.S. Appl. No. 12/950,793, filed Nov. 19, 2010.
U.S. Appl. No. 12/859,701, filed Aug. 19, 2010.
U.S. Appl. No. 12/859,712, filed Aug. 19, 2010.
U.S. Appl. No. 61/377,866, filed Aug. 27, 2010.
Office Action dated Sep. 30, 2009 in U.S. Appl. No. 12/205,824.
Notice of Allowance dated Dec. 21, 2009 in U.S. Appl. No. 12/205,824.
U.S. Appl. No. 12/859,694, filed Aug. 19, 2010.
U.S. Appl. No. 12/859,702, filed Aug. 19, 2010.
Evaluation Report for Utility Model Patent ZL2009201775365 dated May 28, 2010.
Canadian Office Action for 2,735,999 dated Sep. 12, 2011.
Japanese Office Action for 2011-526076 dated Sep. 9, 2011.
Australian Examiner's First Report for 2011203145dated Aug. 25, 2011.
Chinese Office Action for 201020179389.8 dated Feb. 16, 2011.
International Search Report for PCT/US2009/050879 dated Dec. 27, 2010.
Written Opinion for PCT/US2009/050879 dated Dec. 27, 2010.
European Office Action for 09790546.7 dated Dec. 21, 2011.
Office Action for U.S. Appl. No. 12/712,900 dated Jan. 5, 2012.
Written Opinion for PCT/US2011/048404 dated Feb. 13, 2012.
Notice of Allowance for U.S. Appl. No. 12/712,900 dated Apr. 25, 2012.
International Preliminary Report on Patentability for PCT/US2009/080879 dated Mar. 8, 2011.
Partial Search Report for PCT/US2009/050879 dated Oct. 7, 2010.
International Search Report for PCT/US2011/048404 dated Feb. 13, 2012.
Korean Office Action for KR 10-2011-7021855 dated Feb. 6, 2012.
Japanese Final Office Action for 2011-526076 dated Feb. 22, 2012.

* cited by examiner

COMPOSITE MICROPHONE BOOT TO OPTIMIZE SEALING AND MECHANICAL PROPERTIES

BACKGROUND

1. Field of the Invention

The invention relates to consumer electronic devices and more particularly, methods and apparatus for providing microphone capabilities for consumer electronic devices.

2. Description of the Related Art

Many consumer electronic devices provide capabilities for both sound capture and sound generation. For example, portable media players, cellphones, laptop computers, netbook computers and tablet computers often provide capabilities for both sound capture and sound generation. Typically, on these devices, a microphone of some type is used for capturing sound and a speaker of some type is used for generating sound. The microphone and speaker are usually located within an interior of a housing associated with the device.

In various applications, the sound capture and sound generation capabilities are used alone or in combination with one another. For instance, a sound capture capability, such as a microphone, can be used alone as part of an application to record a voice memo, to record a conversation or to input voice commands. Further, a sound generation capability, such as a speaker, can be used alone as part of an application to output music or to playback a message, such as a voice memo or a phone message. In combination, a sound capture and sound generation capability are often used in communication applications. For instance, during a communication between a user and a remote party on a cellphone that includes a microphone and a speaker, the microphone can be used to capture sounds generated from the user while the speaker can be used to output sound from the remote party delivered to the device via the cellular or data network.

In a communication application on a consumer electronic device, where a speaker and a microphone are used simultaneously, it is desirable to isolate the microphone from sounds generated by the speaker. In particular, it is desirable to isolate the microphone from sounds that are transmitted from the speaker through an interior of the consumer electronic device. Thus, in the following sections, methods and apparatus for providing microphone sound isolation are described.

SUMMARY

Broadly speaking, the embodiments disclosed herein describe microphone assembly designs well suited for use in consumer electronic devices, such as laptops, cellphones, netbook computers, portable media players and tablet computers. The microphone assembly can be installed within a consumer electronic device and utilized for applications involving sound recording. In particular, the microphone assembly can be used for wireless communication applications, such as digital telephony.

The microphone assembly can include a microphone coupled to a circuit board and a microphone boot. When the microphone assembly is installed in an interior of a device, the microphone boot can provide a conduit for sound between the microphone and an aperture in a housing of the device. Typically, the microphone boot includes a hollow enclosure that can conduct sound to the microphone. Thus, sound waves from outside the device can enter the aperture in the housing, can pass through the microphone boot and then can be received by the microphone.

Once sound waves have entered through the aperture in the exterior housing, for sound quality purposes, it desirable to minimize any sounds passing through the interior of the housing from mixing with sounds that have entered the microphone boot, such as sounds generated from an internal speaker within the device. To prevent sound penetration into the microphone boot, it is desirable to establish a high seal integrity at both ends of the microphone boot that can be maintained (not broken) during operation of the device. Typically, one end of the microphone boot can be sealed to a surface on the interior of the housing and the other end of the microphone boot can be sealed to a microphone. Methods and apparatus related to microphone boot designs with good sealing qualities are described as follows.

The composite microphone boot can include a compressible center portion that is disposed between two end caps formed from a less compressible material than the center portion. For instance, the end caps can be formed from a hard plastic material and the center portion can be formed from a softer plastic material, such as a silicone plastic. As another example, the end caps can be formed from a softer plastic material and the center portion can be formed from a harder plastic material. In general, the ends cap and the center portion can each be formed from materials of different durometers. In one embodiment, the relative hardness of each of the materials can be selected to improve the sealing integrity and/or the shock absorbing properties of the composite microphone boot.

The composite microphone boot including a hollow interior portion can be formed in a double shot injection molding process. Different materials can each be used during one shot of the double shot injection molding process. For instance, in one shot, a harder plastic material can be used and in the other shot a softer plastic material can be used in the other shot. The materials used in each of the shots can be selected so that they bond together during the injection molding process.

In another embodiment, the end caps and center portion of the composite microphone boot can be separately formed and then stacked together. For instance, the end caps or the center portion can be separately molded or die-cut. The end caps and the center portions can be stacked together and held in place without physically bonding the components to one another. For instance, the components can be mechanically restrained in some manner, such as pressing the components together to hold them in place when they are installed within a device.

During installation, a pressure sensitive adhesive (PSA) can be attached to each end of the composite microphone boot. Then, via the PSA, one end of the composite microphone boot can be bonded to a surface associated with the microphone while the opposite end can be bonded to an inner surface of the housing. A compressive force can be applied to the composite microphone boot. For instance, a microphone assembly including a printed circuit, microphone and microphone boot can be secured to the housing in such a manner that a compressive force is exerted on the microphone boot. The compressive force can be mostly loaded onto the center portion of the composite microphone boot, which can be reduced in thickness as a result. The compressed center portion can exert an outward force against the end caps of the composite microphone boot, which can enable and help maintain a good seal between the PSA and the housing on one end of the microphone boot and the PSA and the microphone on the opposite end of the microphone boot. This implementation can result in a sound isolation of 40 DB or greater.

In particular embodiments, the microphone boot can be formed as a hollow cylinder although other shapes can be utilized if desired. The microphone boot can include a center portion disposed between two end caps. In one embodiment, a size and shape of each end cap can be proximately identical. In other embodiments, the size and shape of each end cap can be different. For example, one end of the microphone boot can be sealed to an interior surface of the housing that is curved, the end cap of the microphone boot facing the interior portion of the housing can be shaped to conform to the shape of the surface of the interior surface to enable a better seal to be formed and maintained.

In one embodiment, a method of manufacturing a portable computing device is described the method. The method can include determining a size, a shape and a material composition of a composite microphone boot. Then, the composite microphone phone boot can be formed. The composite microphone boot can be formed using a double shot injection molding process. Next, opposite ends of the composite microphone boot can be bonded to a microphone and an interior surface of a housing of the portable computing device. For instance, a PSA can be used as a bonding agent. A microphone assembly including the composite microphone boot, the microphone and a printed circuit board can be secured to the housing such that the composite microphone boot is held in place and seals are maintained. Finally, the assembly of the portable computing device including the composite microphone boot can be completed.

Other aspects and advantages will become apparent from the following detailed description taken in conjunction with the accompanying drawings which illustrate, by way of example, the principles of the invention.

BRIEF DESCRIPTION OF THE DRAWINGS

The described embodiments will be readily understood by the following detailed description in conjunction with the accompanying drawings, wherein like reference numerals designate like structural elements, and in which.

DETAILED DESCRIPTION OF THE DESCRIBED EMBODIMENTS

Figure 1A:
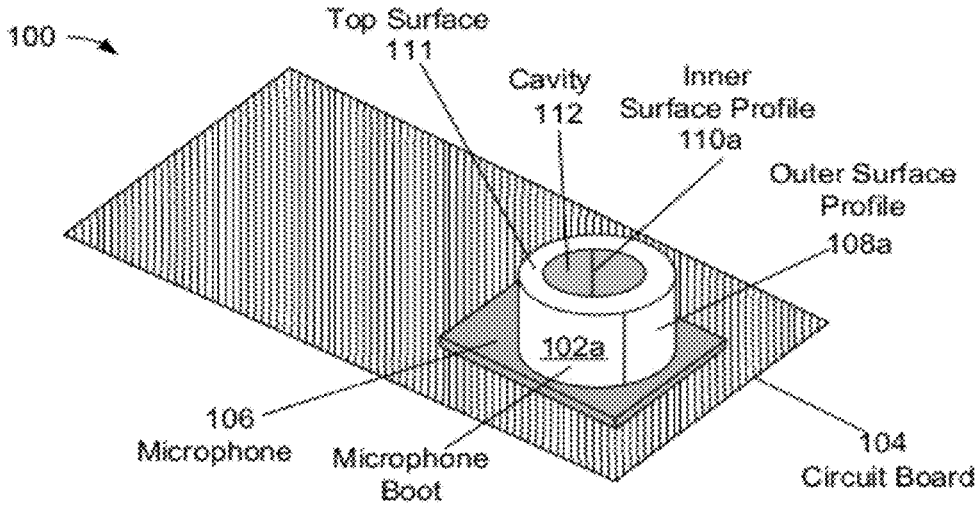
FIGS. 1A-1C show perspective views of a microphone assembly including a microphone and a microphone boot in accordance with the described embodiments.

In the following detailed description, numerous specific details are set forth to provide a thorough understanding of the concepts underlying the described embodiments. It will be apparent, however, to one skilled in the art that the described embodiments can be practiced without some or all of these specific details. In other instances, well known process steps have not been described in detail in order to avoid unnecessarily obscuring the underlying concepts.

In consumer electronic devices, such as a portable computing devices, sound recording capabilities are fairly ubiquitous. Thus, the devices typically can include a microphone of some type. Often, the microphone can be utilized in voice applications, such as digital telephony, voice over IP (VOIP) and voice memos. Also, the microphone can be used in video recording applications where video images and sounds are recorded simultaneously.

The microphone can be located within an interior of the electronic device. For instance, in a portable computing device with a housing, an interior microphone can be provided that is configured to receive sounds via an aperture in the housing. There can be a distance between the interior microphone and the aperture. Thus, a microphone boot can be used to provide a sound conduit between the aperture and the interior microphone.

In a portable computing device, it can be desirable to prevent sounds generated within or passing through the interior from mixing with sounds from an external source that have entered into the microphone boot via the aperture in the housing. For instance, if the device includes an internal speaker, then it can be desirable to prevent internally generated sounds from the speaker from overwhelming externally generated sounds received by the microphone via the microphone boot. In addition, when the externally generated sounds that have entered into the microphone boot are acoustically isolated from other sound sources, then methods, such as echo cancellation can be more easily used. In telephony, echo cancellation describe the process of removing echo from a voice communication in order to improve voice quality on a telephone call. Application of echo cancellation can require knowledge of the acoustic environment, such as the acoustic environment in the microphone boot, which is more easy to determine when the microphone boot is acoustically isolated.

The interior of the microphone boot can be acoustically isolated by forming the microphone boot from a relatively sound-proof material and by providing a good airtight seal at both ends of the microphone boot. Seal integrity can be affected by the material or materials used to form the microphone boot and an approach used to secure the microphone boot. For example, the microphone boot can be secured in a manner such that pressure is maintained on the seals, which helps to preserve seal integrity of the seals at each end of the microphone boot.

The seal integrity can be affected by a relative hardness of a material used to form the microphone boot. An advantage of a harder material is that it can provide a good platform for establishing a seal at each end of the microphone boot. A disadvantage of a harder material is that it can more easily transmit externally generated forces, such as force generated when a device is dropped, into the interior of the device. If a force transmitted by the microphone boot is too great, internal components of the portable computing device can be damaged. In view of the above, designs for microphone boots are described as follows that take advantage of the improved sealing qualities that a harder material can provide while accounting for the shock transmitting properties associated with using harder materials.

In more detail, with reference to FIGS. 1-6C, composite microphone boots are described that can utilize a combination of harder materials selected for their sealing qualities and softer materials selected for their shock absorbing qualities.

However, those skilled in the art will readily appreciate that the detailed description given herein with respect to these figures is for explanatory purposes only and should not be construed as limiting. In particular, embodiments of a composite microphone boots using a combination of harder and softer materials is described with respect to FIGS. 1A-1C. With respect to FIGS. 2A-2B, a few examples of installation positions of a composite microphone boot incorporated as part of a microphone assembly are discussed. In FIG. 3A-3B, a microphone assembly in a pre-installed and installed positions are shown. During installation, the microphone boot can be secured in such a manner that it is compressed, which can improve sealing integrity. Transmission of an external force through a microphone boot during operation is described with respect to FIG. 3C. With respect to FIGS. 4A-4C, different embodiments of a composite microphone boot. including dimensions and materials, are discussed. A method of manufacturing a portable computer device including a composite microphone boot is described with respect to FIG. 5. Finally, with respect to FIGS. 6A-6C, perspective diagrams and a block diagram of a portable computing device that can include a composite microphone boot are discussed.

Figure 1B:
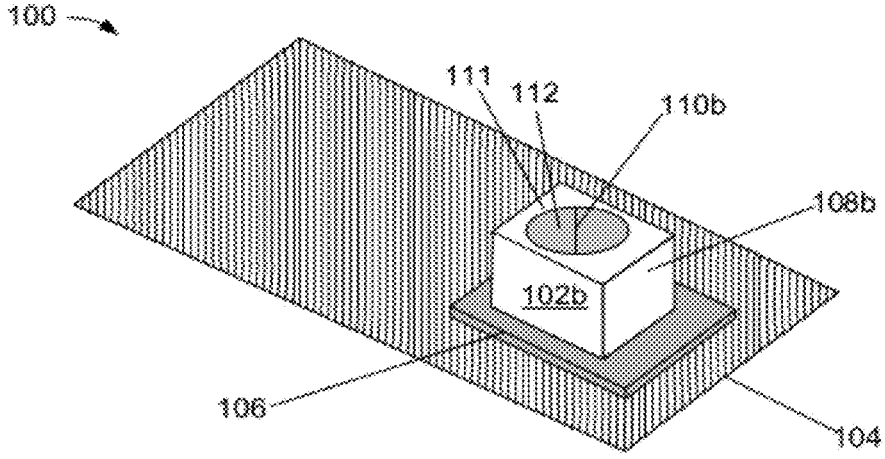
Figure 1C:
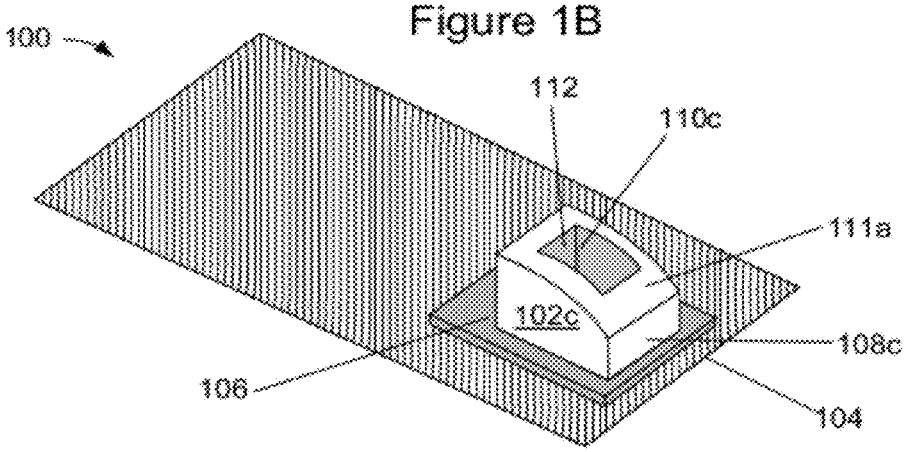

FIGS. 1A-1C show perspective views of a microphone assembly 100 including a microphone 106, circuit board 104 and a microphone boot, such as 102*a*, 102*b* and 102*c*. The microphone 106 is shown coupled to the circuit board 104. In particular embodiments, the circuit board can be formed from a rigid or a flexible substrate. The microphone boot, such as 102*a*, 102*b* and 102*c*, can include surfaces that surround a cavity 112. The cavity 112 can act as a sound conduit. For instance, as described above and in more detail with respect to FIGS. 2A and 2B, in a portable computing device, the cavity 112 can be acoustically coupled to an aperture in a housing to act as a sound conduit to an interior microphone for sounds generated from a source external to the portable computing device.

The microphone boot can include an inner surface profile and an outer surface profile. The inner surface profile provides the bounds for the interior cavity 110*a*. As shown in FIG. 1A, the microphone boot 102*a* is cylindrically shaped. In this example, the outer surface profile 108*a* and the inner surface profile 110*a* can be proximately described as two concentric cylinders. The top surface 111 and bottom surface of the microphone boot 102*a* are proximately flat.

The inner surface profile and the outer surface profile of the microphone boot do not have to be formed from concentric shapes. In general, the inner and outer surface profiles can be different from one another and each can be arbitrarily shaped where the shape can vary from the top surface to the bottom surface. For instance, the cavity 112 can be wider at the top and narrower at the bottom. Further, the cavity 112 can be one shape at the top and another shape at the bottom. In addition, in a particular embodiment, the cavity 112 can follow a curved path through the interior of the microphone boot.

As one example, in FIG. 1B, a microphone boot 102*b* with a different outer and inner surface profiles is shown. The microphone boot 102 includes a cylindrically shaped inner surface profile 110*b* and a rectangular shaped outer surface profile 108*b*. In another example, the shape profile could be reversed so that the inner surface profile 110*b* is rectangular shaped and the outer surface profile 108*b* is cylindrically shaped. Like the example shown in FIG. 1A, the top surface 111 and the bottom surface of the microphone boot are both flat.

In various embodiments, one or both of the top and bottom surfaces of the microphone boot can be curved. As an example, in FIG. 1C, a microphone boot 102*c* is shown that includes a curved top surface 111*a* and a flat bottom surface. The microphone boot 102*c* includes a rectangular shaped inner surface profile 110*c* and a rectangular shaped outer surface profile 108*c*.

In some embodiments, a top surface of the microphone boot, such as 111*a*, can be bonded to a curved interior surface of a device's housing. To improve seal integrity, it can be beneficial to shape the top surface, such as 111*a*, so that its curvature somewhat conforms to the curvature of the interior surface of the housing. For example, curving the top surface to conform to the interior surface of the housing can result in a more equal pressure over the top surface, which can improve sealing integrity. In other embodiments, a microphone boot with a flat top surface can be bonded to a curved interior surface or a microphone boot with a curved top surface can be bonded to a flat interior surface. In this embodiment, the flat or curved top surface of the microphone boot can be made to conform to the interior surface using compressive forces, i.e., by compressing the microphone boot.

In the FIGS. 1A-1C, a top surface of the microphone 106 is shown as flat and a microphone boot with a flat bottom surface is shown bonded to the flat top surface of the microphone. In other embodiments, the top surface of the microphone 106 can be sloped or curved and if desired a bottom surface of the microphone boot, such as 102*a*, 102*b* and 102*c*, can be sloped to somewhat conform to the top surface of the microphone. As described above, shaping the microphone boot in this manner may improve a sealing integrity between the bottom surface of the microphone boot and a top surface of the microphone.

In other embodiments, the bottom surface of the microphone boot and the top surface of the microphone can be shaped differently. For instance, a top surface of a microphone can be curved and the bottom surface of the microphone boot can be flat. The bottom portion of the microphone boot can be formed from a compressible material such that when the flat bottom surface of the microphone boot is pressed to the curved surface of the microphone, the flat bottom surface of the microphone boot conforms to the curved top surface of the microphone.

As described above, the microphone assembly can be installed in an interior of a device, such as a portable computer device. The microphone assembly and its associated microphone boot can be positioned such that it is aligned with an aperture in the housing and provides a sound conduit between the aperture and the microphone. The aperture can be located at various locations on an exterior surface of the device. The placement of the aperture can affect a placement position and orientation of the microphone boot. Two examples of a microphone assembly in different orientations within a portable computing device are described as follows with respect to FIGS. 2A and 2B.

Figure 2A:
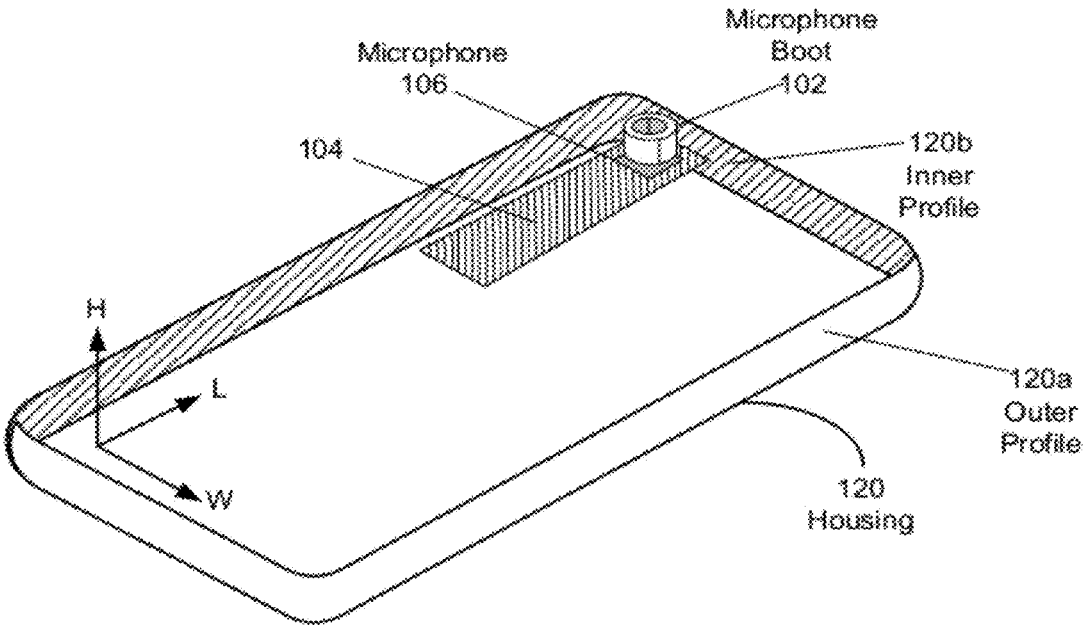
FIG. 2A-2B shows perspective views of a microphone assembly in different orientations in a housing of a portable computing device in accordance with the described embodiments.
Figure 2B:
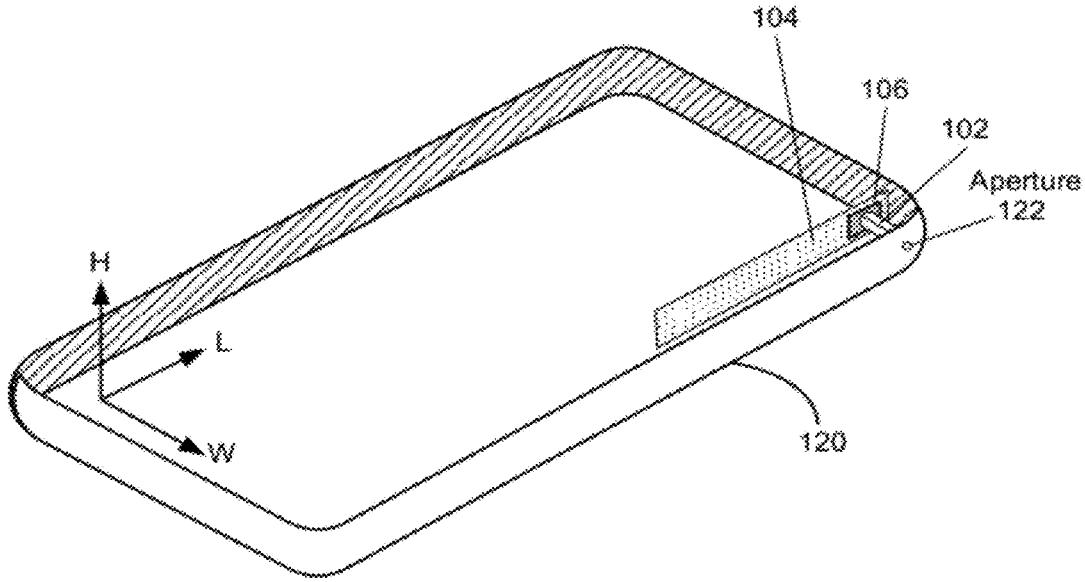
Figure 3A:
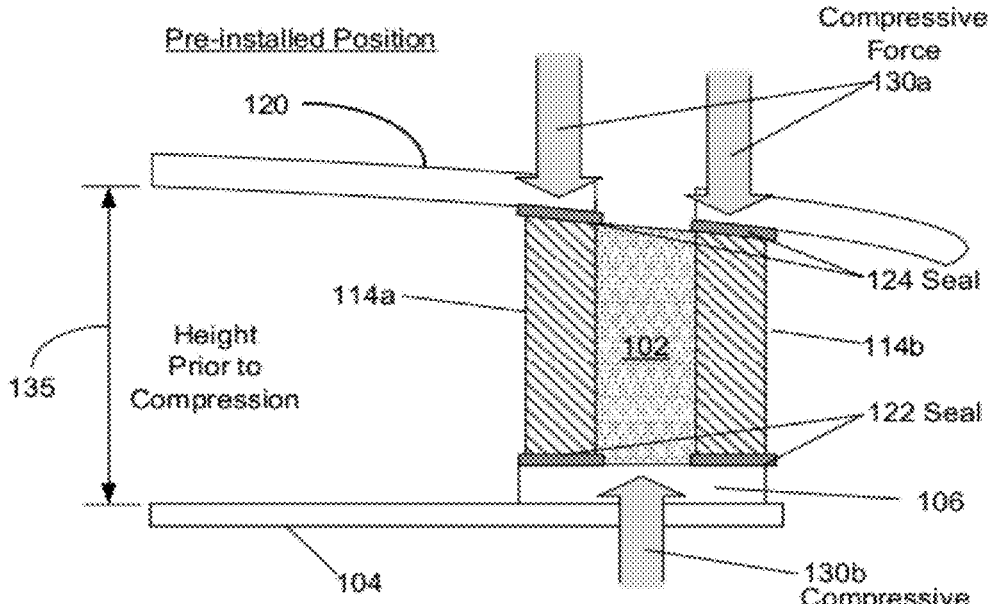
FIGS. 3A-3B show a side view of a microphone assembly in a pre-installed and installed position in a housing in accordance with the described embodiments.
Figure 3B:
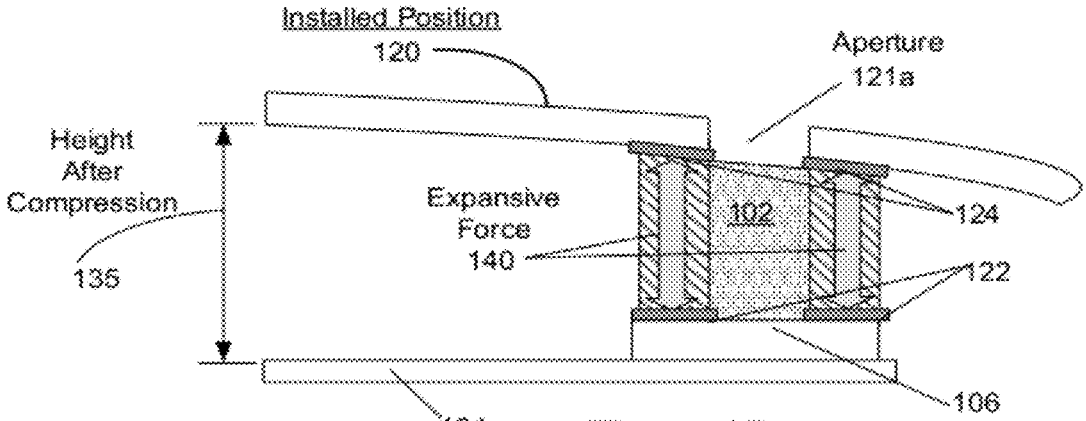

In FIGS. 2A and 2B, a microphone assembly including a microphone 106, a circuit board 104 and a microphone boot 102 is shown positioned within an interior portion of a housing 120 for portable computing device. The housing 120 is proximately rectangular. The outer surface of the housing 120 includes an outer surface profile 120*a* and an inner surface profile 120*b*. The outer surface profile 120*a* and inner surface 120*b* can be shaped differently from one another. For instance, the outer surface 120*a* can be flat in one region but the corresponding interior portion can be curved. The shape of the interior surface proximate to the microphone boot can affect a sealing integrity of the seal between the microphone boot and the interior surface. As described above, in some embodiments, a top surface of the microphone boot can be shaped to conform to the shape of the interior surface of the housing to improve the sealing integrity. Sealing integrity can be important because a good, air-tight seal can help to acoustically isolate the sound conduit within the interior of the microphone boot.

Figure 6A:
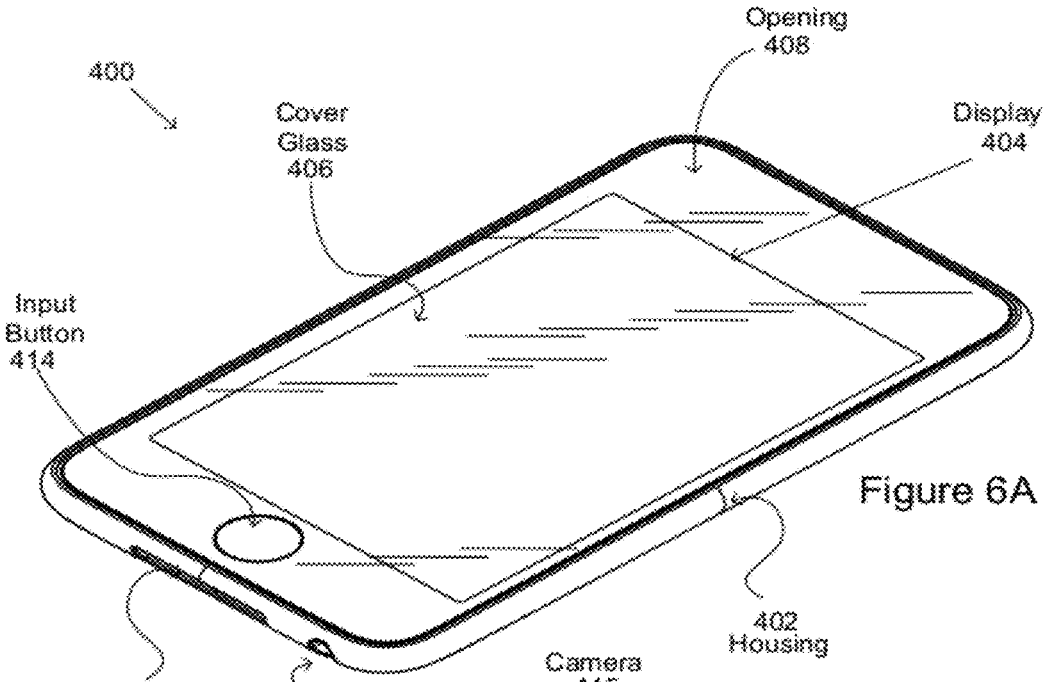
FIG. 6A shows a top view of a portable electronic device in accordance with the described embodiments.

In FIG. 2A, the microphone boot 102 is shown orientated upward and the cavity in the microphone boot is aligned from the top to the bottom of the housing along the 'H' axis. In this embodiment, a top cover, such as a cover glass can be placed over the opening the housing 120. An embodiment of a portable computing device including a housing with a cover glass is shown in FIG. 6A. The top cover can include an aperture. During installation, the microphone assembly can be positioned in the housing such that the top surface of the microphone boot is aligned with where the aperture in the top cover will be in its installed position. Then, when the top cover is installed, a bottom surface of the top cover can be bonded to the top surface of the microphone boot to generate a sound conduit between the aperture in the top cover and the microphone via the microphone boot.

In another embodiment, a housing, such as 120, can include an aperture 122 for a microphone, such as 106. In FIG. 2B, the housing 120 is shown with an aperture 122 in its side near a corner. The microphone 106 and the circuit board 104 are shown positioned such that a top surface of the microphone and the circuit board are proximately parallel to the side with the aperture and an opening in the microphone boot 102 is aligned with the aperture. A sound conduit associated with the microphone boot is proximately aligned with the 'W' axis.

Other orientations of the microphone assembly and microphone boot are possible and are not limited to the orientations shown in FIGS. 2A and 2B. For instance, on one embodiment, a top surface of the microphone boot 102 can be bonded to the inner surface of the housing proximate to the aperture 122 to form a sound conduit. Then, the orientation of the circuit board and the microphone can be adjusted such that the microphone boot and its internal conduit are slightly bent in some manner. The microphone boot can be constructed from a flexible material to enable bending. It may not be desirable to bend the microphone boot beyond some determined limit to avoid possibly pinching off the sound conduit in the interior of the microphone boot.

In another embodiment, a curved microphone boot can be provided. For example, a microphone boot can be constructed like pipe elbow. The pipe elbow can be provided in a bent shape where the elbow is bent through some angle. A bent microphone boot can allow the orientation of the microphone and the printed circuit board to be changed relative to the housing, which may be desirable for packaging reasons. More details of bonding a microphone boot 102 to the housing 120 are described with respect to FIGS. 3A and 3B as follows.

FIGS. 3A-3B show a side view of a microphone assembly in a pre-installed and installed position, respectively, in a housing in accordance with the described embodiments. In FIG. 3A, a cross section of the microphone boot 102 is shown. One end of the microphone boot 102 is aligned with an aperture 121*a* in the housing 120 and a second end of the microphone boot is aligned with the microphone 106. Thus, a sound conduit can be formed via the microphone boot between the aperture 121*a* and the microphone 106.

A first seal 122 can be formed between a bottom surface of the microphone boot 102 and a top surface of the microphone 106. A second seal 124 can be formed between a top surface of the microphone boot 102 and an interior surface of the housing 120 such that the microphone boot surrounds the aperture in the housing 120. In one embodiment, the first and second seals can be formed using an adhesive, such as a pressure sensitive adhesive (PSA). The PSA can be provided as a double-sided tape. In another embodiment, the first 122 or the second seal 124 can be formed using a liquid adhesive.

In one embodiment, the microphone 106 and circuit board 104 can be provided with the microphone boot 102 already attached to the microphone 106. In another embodiment, during device assembly, the microphone 106 and the circuit board 104 can be provided as a separate part from the microphone boot 102. When the microphone boot and microphone are provided as separate parts, the microphone boot 102 can be first attached to the microphone 106 and then attached the inner surface of the housing 120 or vice versa. The attachment process can involve placing PSA or some other sealing adhesive on each end of the microphone boot.

After the microphone boot 102 is aligned with the aperture 121*a* of the housing and an initial bond is formed between the microphone boot and the interior of the housing, compressive forces, such as 130*a* and 130*b*, can be placed on the microphone boot. The compressive forces can be generated when the microphone boot 102, microphone 106 and circuit board 104 are secured in place. For example, one or more fasteners, such as screws, can be used to secure the circuit board 104 to the housing 120 or some other nearby structure. As the screws are seated, the compressive forces can be generated on the microphone boot 102. The compressive forces can be used to squeeze out any air pockets surrounding the seals, which may improve the sealing integrity of the seal.

As is shown in the FIG. 3A, the housing 120 is curved proximate to the microphone boot 102. Thus, the compressive forces can be unequally distributed through the microphone boot. For instance, the compressive forces on side 114*a* of the microphone boot can be less than the compressive forces on side 114*b* of the microphone boot. As described above, in some embodiments, the microphone boot 102 can be shaped to more evenly distribute the compressive forces. For instance, the top surface of the microphone boot can be sloped to follow the curvature of the inner surface of the housing 120. In other embodiments, the top surface of the microphone boot 102 may not follow the curvature of the inner surface of the housing (e.g., the top surface can be flat while the inner surface is curved as shown in FIG. 3A) and the compressive forces can be used to force a top surface of the microphone boot to deform such that it conforms with the inner surface of the housing.

A height 135 between the circuit board 104 and one position of the housing is shown in FIG. 3A. After installation, as is shown in FIG. 3B, the height 135 can change. For instance, the height 135 can lessen, which can be associated with a reduction in height of the microphone boot 120. The amount height reduction of the microphone boot can depend on its original dimensions, materials used to form the microphone boot and an amount of compressive force that is placed on the microphone boot.

The reduction in height of the microphone foot can result in an expansive force 140 being transferred to the microphone boot. The expansive force 140 can push against the seals 122 and 124, which can improve the seal integrity of the seals. For instance, as described above, the compressive forces can help to remove air pockets. Improving the seal integrity can result in better acoustic isolation characteristics for the sound conduit in the interior of the microphone boot 102. For instance, as the seals become more air tight, sound penetration into the microphone boot via sound paths within the interior of the housing 120 can be reduced. In one embodiment, the acoustic isolation within the sound conduit of the microphone boot can be about 40 DB or greater.

Figure 3C:
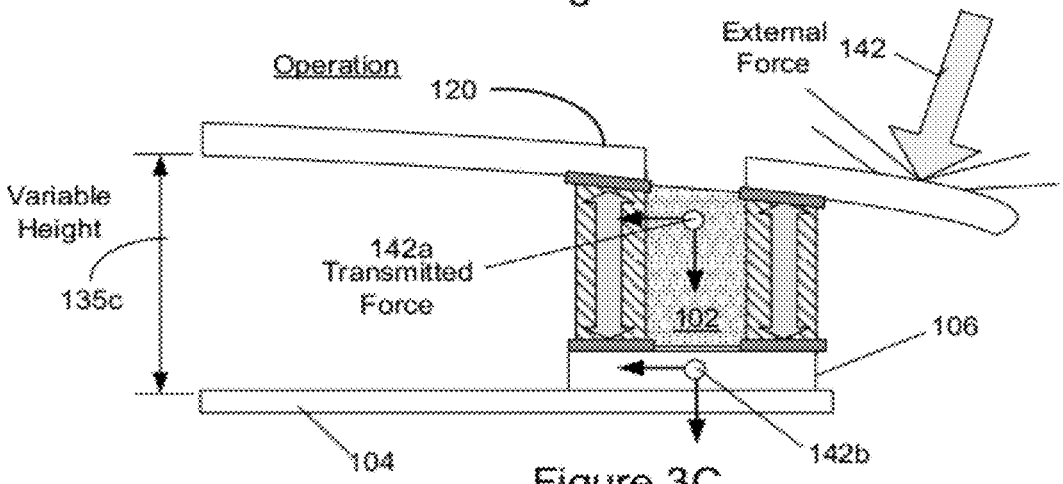
FIG. 3C shows a side view of a microphone assembly in a housing that is responding to an externally applied force.

FIG. 3C shows a side view of a microphone assembly installed in the housing 120 that is responding to an externally applied force 142. During operation, a device, such as a portable computing device, can experience an externally applied force, such as 142. For instance, the device can be dropped, which generates the force.

The externally applied force can be transmitted through the device via various pathways. A force, such as 142*a*, can be transmitted through the microphone boot 102 and then a force, such as 142*b*, can be transmitted into the microphone 106 and into the circuit board 104. The force can be transmitted in a dynamic manner. For instance, the microphone boot can compress and then can expand in response to the force causing the height 135*c* to change. The expansion and contraction of the microphone boot can push and pull at the attachments between the various components, such as between the microphone 102 and circuit board 104 and on each side of the seals, 122 and 124.

If the microphone boot is not designed properly, the expansion and contraction of the microphone boot 102 as well as bending of the other parts, such as the circuit board 104, can cause the seal integrity of the seals, such as 122 or 124, to degrade. Under testing, for some microphone boot designs, it was found that the seals, such as 122 or 124, can be pulled apart, the microphone 106 can be pulled off the circuit board 104 or the circuit board can be damaged. In one embodiment, the microphone assembly can be designed to withstand an acceleration of up to 10,000 g's, which can bound a magnitude of the externally applied force.

During testing, it was found that microphone assemblies using a microphone boot formed a single material that is softer and more compressible can be more resistant to shock damage, such as a shock resulting from a sudden acceleration, than a microphone boot formed from a harder material. However, it was also found that a microphone boot formed from a single harder material can provide for better seal integrity and hence better acoustic isolation than a microphone boot formed from a softer material. However, microphone assemblies using a microphone boot formed from a harder material can be more susceptible to shock damage.

To take advantage of the shock resistance properties of a softer material and the improved sealing qualities of a hard material, composite microphone boot designs can be provided. The composite microphone boot can use a combination of hard and soft materials. The harder materials can be used to improve seal integrity while the softer materials can be used to improve shock resistance. Embodiments of composite microphone boot designs that can be utilized in a microphone assembly are described with respect to FIGS. 4A-4C as follows.

Figure 4B:
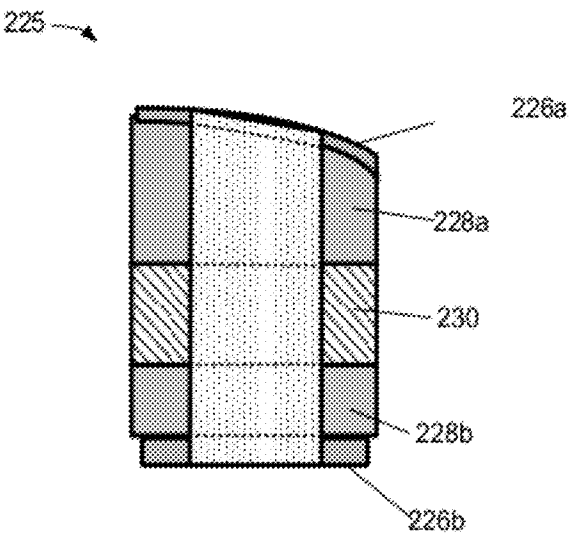
FIGS. 4A-4D show cross-sections and a top view of a composite microphone boot in accordance with the preferred embodiments.
Figure 4A:
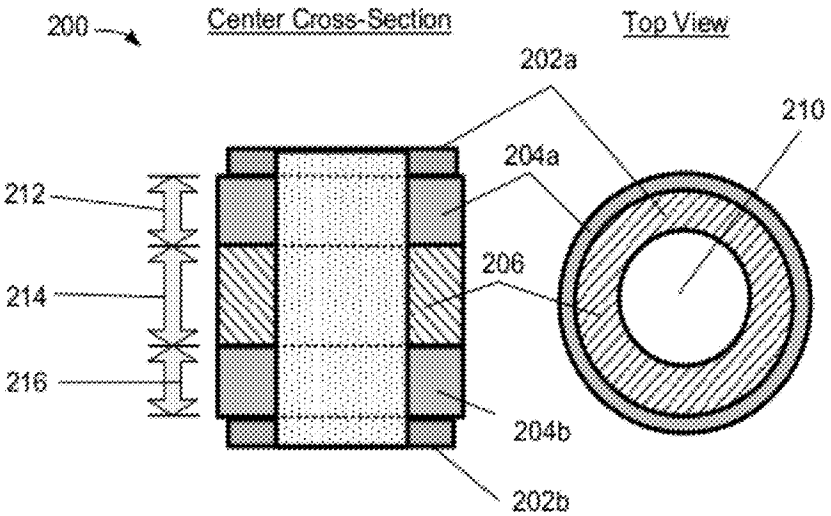
Figure 4D:
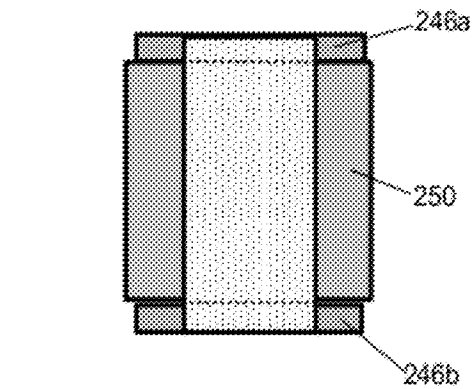
Figure 4C:
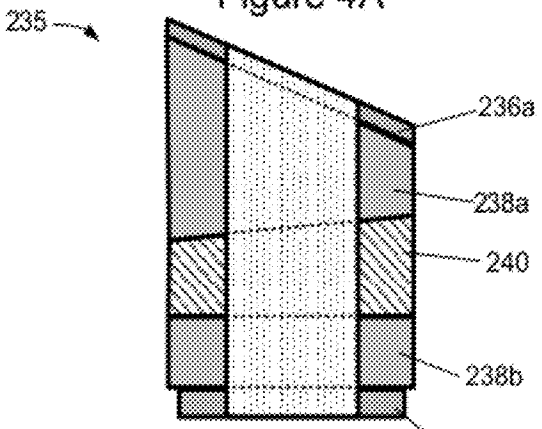

FIGS. 4A-4C show cross-sections of composite microphone boots, such as 200, 225 and 235, in accordance with the preferred embodiments. A top and bottom seal is shown formed on each of the microphone boots. In FIG. 4A, a top view of a microphone boot 200 including a seal 202*a* is shown. The top view shows the microphone boot 200 includes a circular opening 210 to the interior passageway 215 that forms a sound conduit through the microphone boot. A washer like seal 202*a* can be formed on top of the microphone boot 200. As described above, the outer and inner surface profiles of the microphone boot, such as 200, can vary through the interior passage way. Thus, the top view of the microphone boot can vary depending on the surface contours selected for the outer and inner profiles. The seal 202*a* can be designed to almost cover the top surface of the microphone boot 200. Thus, the shape of seal 202*a* can vary accordingly.

Returning to FIG. 4A, the microphone boot can include a first end cap portion 204*a*. The first end cap 204*a* can be formed from a first material and can have a first thickness 212. A sealing portion 202*a* can be bonded to a top of the first end cap 204*a*. A second end cap 204*b* can be located on a bottom of the microphone boot. The second end cap can formed from a second material and can have a second thickness 216. A center portion 206 of the microphone boot of a thickness 214 can be disposed between the first end cap 204*a* and the second end cap 204*b*. The center portion can be formed from a third material. The first thickness 212, the second thickness 216, and the third thickness 214 can be different from one another.

A sealing portion 202*b* can be bonded to the second end cap 204*b*. As previously described, the sealing portion 202*a* can be bonded to a surface, such as the interior surface of a housing. The sealing portion 202*b* can be bonded to a surface, such as a top surface of a microphone. The sealing portions 202*a* and 202*b* can be formed from a common material or a different material. For instance, the sealing portions can be formed from a common PSA or two different PSAs.

In particular embodiments, the first and second materials used for the first end cap 204*a* and the second cap 204*b* can be selected for their ability to improve sealing integrity while the third material of the center portion 204 can be selected for its shock absorbing qualities. As described above, using a hard material can improve sealing integrity associated with the microphone boot seals, such as 202*a* and 202*b*, while using a softer material can improve the shock resistance of the microphone assembly. Thus, the materials selected for the first end cap and the second cap can be formed from harder materials to improve sealing integrity and the center portion can be formed from a softer, more compressible material than the first end cap and the second cap, to improve the shock resistance. In one embodiment, the first and second end caps can be formed from hard plastics and the center portion can be formed from a softer plastic than the end caps, such as a silicon based plastic.

In a particular embodiment, the first end cap 204*a* and the second end cap 204*b* can be formed from a first material harder material and the center portion can be formed from a second softer material. A microphone boot designed in this manner can be integrally formed during a double shot injection molding process where during one shot the first material is used and during the other shot the second material is used. The first and second material can be selected such that the materials bond together during the double shot injection molding process. In other embodiments, the first end cap 204*a*, the second end cap 204*b* and the center portion 206 can be separately formed, such as die cut, and then bonded together in some manner to form the microphone boot.

In one embodiment, the first end cap 204*a* and the second cap 204*b* can be proximately identically shaped with a common thickness. However, the thickness 214 of the center portion can be different. In other embodiments, the first end cap and the second cap can be shaped differently. For instance, in FIG. 4B, a microphone boot 225 is shown where the first end cap 228*a* is shaped differently than the second end cap 228. The microphone boot includes a center portion 230 and the materials used for the center portion 230, the first end cap 228*a* and the second end cap 228*b* can be selected to improve sealing integrity and/or shock resistance in the manner described above.

A top surface of the first end cap 228*a* can be curved or sloped in some manner. As described above, it can be desirable to shape the first end cap 228*a* to conform proximately to a surface to which it is to be bonded. For instance, the first end cap 228*a* can be shaped to conform to a curved interior surface of a housing as is shown in FIGS. 3A to 3C. The seals, 226*a* and 226*b*, can be bonded to each of the first end cap 228*a* and the second end cap 229*b*. The seals can be shaped to follow surfaces to which they are bonded. Thus, seal 226*a* can be curved to follow the shape of the first end cap 228*a* while seal 226*b* is relative planer to follow the planar shape of the bottom end cap 228*b*.

In FIGS. 4A and 4B, the center portions 206 and 230 of the microphone boots are shown with a relatively constant thickness. In other embodiments, the thickness of the center portion of a microphone boot can vary. For example, in FIG. 4C, a microphone boot 235 is shown where the thickness of the center portion 240 varies. The microphone boot 235 can include a first end cap 238*a* with a sloped upper surface and a second end cap 238*b* with a planar bottom surface. The seals 236*a* and 236*b* can be attached to each end cap. The thickness of the second end cap 238*b* is shown as relatively constant for this example.

In FIG. 4C, the thickness of the center portion 240 varies from thicker to thinner. In addition, the thickness of the first end cap 238 is thickened in areas where the center portion 240 is thinner and thinned in areas where the center portion is thicker. In other embodiments, the interface between the center portion 240 and the first end cap 238*a* can be relatively horizontal and the second end cap can be made thinner or thicker, such that the interface between the center portion 240 and the second end cap 238*b* is sloped, to allow the center portion thickness profile to vary. In yet another embodiment, the interfaces between the first end cap 238*a* and the center portion 240 and the second end cap 238*b* can both be sloped in some manner.

The thickness of the center portion 240 of the microphone boot can be varied to change a distribution of compressive forces within the microphone boot when it is installed. For instance, the thickness of the center portion 240 can be varied to produce a more even distribution of compressive forces and possible a better seal for an end cap, such as 238*a*. In other embodiments, the center portion 240 can be made thicker or thinner in particular areas to adjust the shock absorption properties in these areas. In yet other embodiments, the center portion can be made thicker or thinner in particular areas to generate a preferred shock transmission path such as to direct a shock away from a more vulnerable area and towards an area with more structural reinforcement.

In the composite microphone boots described with respect to FIGS. 4A-4C, multiple materials are used to form the composite boot. In one embodiment, as is shown in FIG. 4D, a single material can be used for the microphone boot. The microphone boot 245 includes a center portion 250 of a single material. Seals 246*a* and 246*b* are shown attached to the microphone boot. It may be possible to use a single material, such as a single harder material, selected for its ability to improve seal integrity, if shock absorption effects are compensated for in some other manner rather than using a second shock absorbing material.

In one example, the geometry of the microphone boot, such as 245, can be adjusted to change it shock absorbing characteristics. For instance, a bulge, such as 250*a*, can be provided in the microphone boot 245 to help dissipate shocks that are transmitted through the microphone boot. In another example, the microphone assembly can be adjusted in some manner to improve its shock absorbing capabilities. For instance, shock dampening features can be designed into the way the microphone assembly is attached or a more flexible circuit board can be used in the microphone assembly to improve its dampening characteristics.

Figure 5:
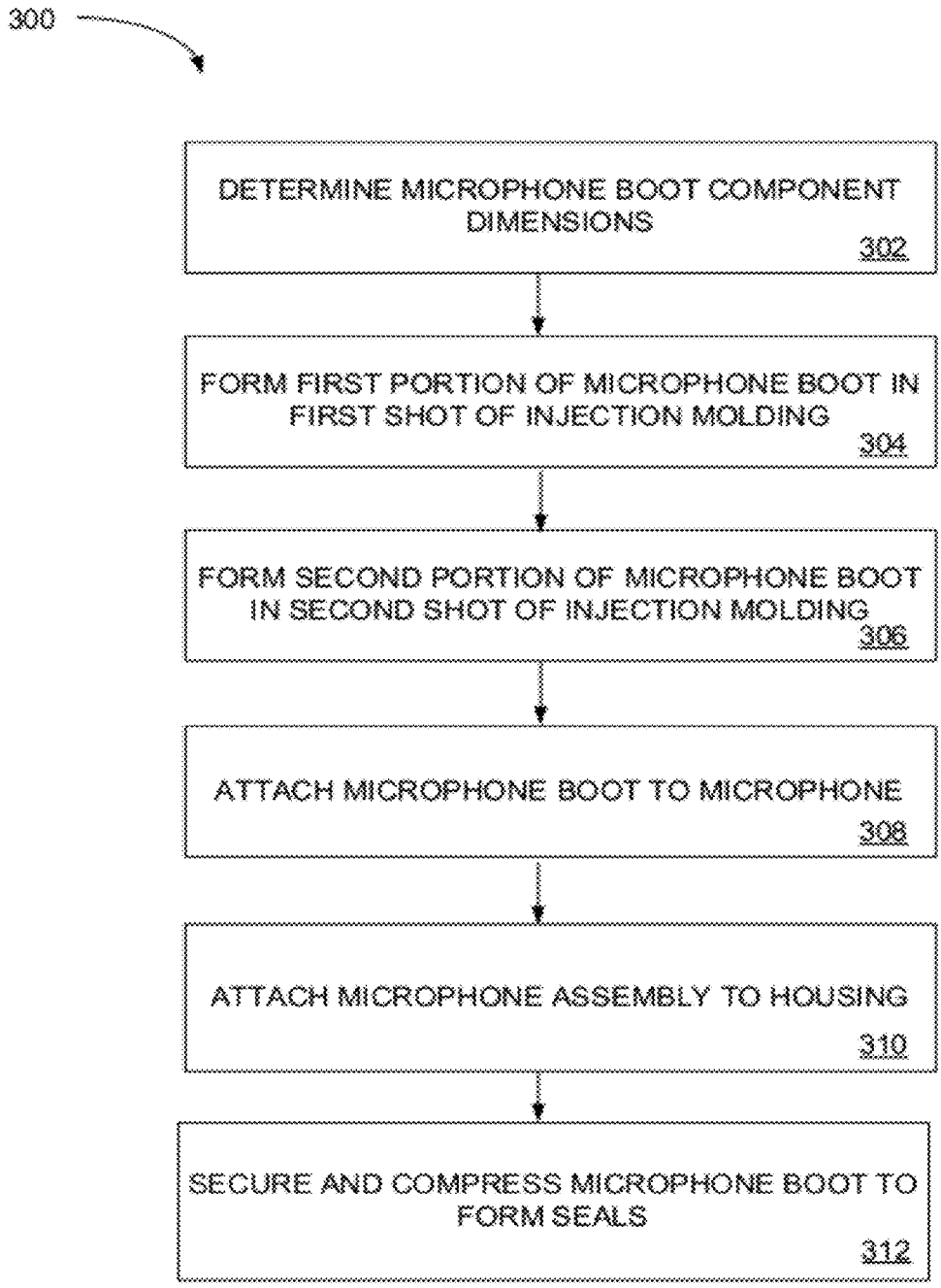
FIG. 5 is a flow chart of a method of manufacturing a portable computer device including a composite microphone boot in accordance with the preferred embodiments.

FIG. 5 is a flow chart 300 of a method of manufacturing a portable computer device including a composite microphone boot in accordance with the preferred embodiments. In 302, microphone boot dimensions and materials can be selected. For instance, in a composite microphone boot including a center portion disposed between two end caps, the dimensions to be used for each of the end caps and the center portion can be determined. The dimensions can be selected to improve sealing integrity and shock absorption properties of the microphone boot. Further, the materials to be used for each component can be selected. As previously described, the materials can also be selected to improve sealing integrity and the shock absorption properties of the microphone boot.

Next, a microphone boot according to the specified dimensions and materials can be formed. In one embodiment, the microphone boot can be a composite microphone boot formed from multiple materials and components that are integrally formed using an injection molding process. In 304, a first portion of the microphone boot can be formed in one shot of a double shot injection molding process. In 306, a second portion of the microphone boot can be formed in another shot of the injection molding process. A different material can be used in each of the shots. In other embodiments, the different portions of the microphone boot can be formed separately and then assembly together after each of the components is formed.

In 308, the microphone boot can be attached to a microphone. The microphone can be part of a microphone assembly including a microphone coupled to a circuit board and the microphone boot. In 310, the microphone assembly can be attached to the housing of an electronic device, such as a portable computing device to form a seal between the microphone and the housing. In one embodiment, the seal can be formed using a pressure sensitive adhesive. In 312, when the assembly is secured, the microphone boot can be compressed in some manner. The compression can change the dimensions of the microphone boot and cause the microphone boot to exert a force on its associated seals. The exerted force can be used to improve seal integrity of the seals.

In method described above, one or more of the steps can be performed using a computer aided manufacturing process. The computer aided manufacturing process can involve programming one or more different devices to form or assemble the microphone boot and the portable computing device. For instance, a robotic device can be programmed to install a microphone boot and/or a microphone assembly including the microphone in a particular orientation within a housing of the portable computing device.

Figure 6B:
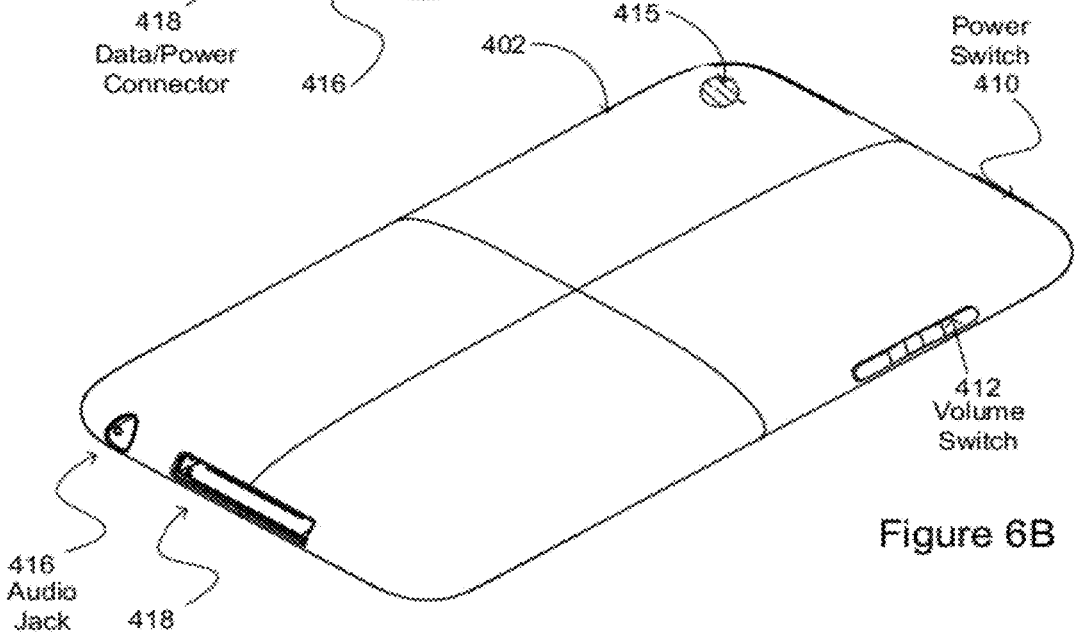
FIG. 6B shows a bottom view of a portable electronic device in accordance with the described embodiments.

FIGS. 6A and 6B show a top and bottom view of a portable computing device 400 in accordance with the described embodiments. The portable computing device can be suitable for being held in hand of a user. A cover glass 406 and a display 404 can be placed within an opening 408 of housing 402. The cover glass can include an opening for an input mechanism, such as input button 414. In one embodiment, the input button 414 can be used to return the portable computing device to a particular state, such as a home state.

Other input/output mechanisms can be arranged around an periphery of the housing 402. For instance, a power switch, such as 410 can be located on a top edge of the housing and a volume switch, such as 412, can be located along one edge of the housing. An audio jack 416 for connecting headphones or another audio device and a data/power connector interface are located on the bottom edge of the housing. The housing 400 also includes an aperture for a camera 415 that allows video data to be received.

Figure 6C:
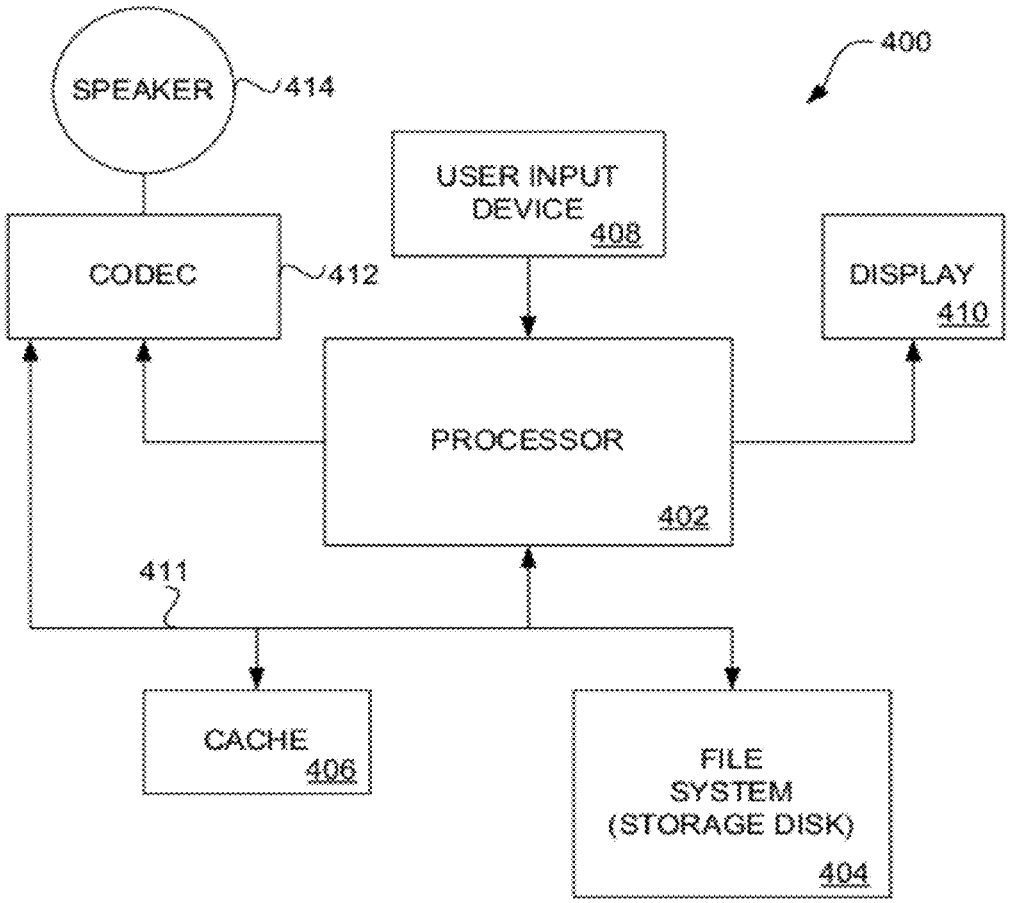
FIG. 6C is a block diagram of a media player in accordance with the described embodiments.

FIG. 6C is a block diagram of a media player 500 in accordance with the described embodiments. The media player 500 includes a processor 502 that pertains to a microprocessor or controller for controlling the overall operation of the media player 500. The media player 500 stores media data pertaining to media items in a file system 504 and a cache 506. The file system 504 is, typically, a storage disk or a plurality of disks. The file system typically provides high capacity storage capability for the media player 500. However, since the access time to the file system 504 is relatively slow, the media player 500 also includes a cache 506. The cache 506 is, for example, Random-Access Memory (RAM) provided by semiconductor memory. The relative access time to the cache 506 is substantially shorter than for the file system 504. However, the cache 506 does not have the large storage capacity of the file system 504.

Further, the file system 504, when active, consumes more power than does the cache 506. The power consumption is particularly important when the media player 400 is a portable media player that is powered by a battery (not shown).

The media player 500 also includes a user input device 408 that allows a user of the media player 500 to interact with the media player 500. For example, the user input device 508 can take a variety of forms, such as a button, keypad, dial, etc. Still further, the media player 400 includes a display 510 (screen display) that can be controlled by the processor 502 to display information to the user. A data bus 111 can facilitate data transfer between at least the file system 504, the cache 506, the processor 502, and the CODEC 512.

In one embodiment, the media player 500 serves to store a plurality of media items (e.g., songs) in the file system 504. When a user desires to have the media player play a particular media item, a list of available media items is displayed on the display 510. Then, using the user input device 508, a user can select one of the available media items. The processor 502, upon receiving a selection of a particular media item, supplies the media data (e.g., audio file) for the particular media item to a coder/decoder (CODEC) 512. The CODEC 512 then produces analog output signals for a speaker 514. The speaker 514 can be a speaker internal to the media player 500 or external to the media player 100. For example, headphones or earphones that connect to the media player 500 would be considered an external speaker.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A composite microphone boot comprising:

a first end cap shaped to conform to a curved interior surface of a portable computing device;

a second end cap shaped to conform to an exterior surface of a microphone;

a center portion disposed between the first end cap and the second cap, the center portion, the first end cap and the second cap surrounding a hollow interior portion configured to direct sound entering via an aperture in a housing of a portable computing device to the microphone wherein the first end cap and the second end cap are formed from at least one first material, the center portion is formed from a second material that separates the first end cap and the second end cap such that the first end cap and the second end cap do not touch each other, and the second material is softer material than the at least one first material to act as a shock absorber during operation of the portable computing device.

2. The composite microphone boot of claim 1, wherein the at least one first material is at least one silicon based plastic.

3. The composite microphone boot of claim 1, wherein the composite microphone boot is formed during a double shot injection molding process.

4. The composite microphone boot of claim 1, wherein the first end cap, the second end cap and the center portion are separately formed.

5. The composite microphone boot of claim 4, wherein the first end cap, the second end cap and the center portion are installed and held in place within the portable computing device via a mechanical restraint without physically bonding the first end cap, the second end cap and the center portion to one another.

6. The composite microphone boot of claim 1, wherein the microphone boot is cylindrically shaped.

7. A microphone assembly comprising:

a circuit board;

a microphone coupled to the circuit board;

a composite microphone boot bonded to the microphone comprising a center portion disposed between a first end cap and a second end cap, the center portion, the first end cap and the second cap surrounding a hollow interior portion configured to direct sound entering via an aperture in a housing of a portable computing device to the microphone wherein the first end cap and the second end cap are formed from at least one first material of at least one first durometer, the center portion is formed from a second material of a second durometer and wherein the center potion separates the first end cap and the second end cap such that the first end cap and the second end cap do not touch each other and the second durometer is of a different hardness than the first durometer to configure the composite microphone boot to act as a shock absorber during operation of the portable computing device.

8. The microphone assembly of claim 7, wherein the second end cap is bonded to an exterior surface of the microphone via a pressure sensitive adhesive (PSA).

9. The microphone assembly of claim 7, wherein an upper surface of the end cap is curved to conform to an interior surface of the housing of the portable computing device.

10. The microphone assembly of claim 7, where the first end cap and the second cap are formed from softer materials than the center portion.

11. The microphone assembly of claim 7, wherein the first end cap and the second end cap are formed from harder materials than the center portion.

12. The microphone assembly of claim 7, wherein a thickness of the center portion surrounding the hollowing interior portion varies.

13. A portable electronic device comprising:

a housing;

a microphone disposed within an interior of the housing; and a composite microphone boot configured to provide a sound conduit between an aperture in the housing and an exterior surface of the microphone, said composite microphone boot comprising: 1) a first end cap bonded to the microphone, 2) a second end cap bonded to an interior surface of the housing and 3) a center portion disposed between the first end cap and the second end cap that separates the first end cap and the second end cap such that the first end cap and the second end cap do not touch each other;

wherein the first end cap and the second end cap are formed from a hard material and the center portion of the composite microphone boot is formed from a shock absorbing material that is softer than the hard material.

14. The portable electronic device of claim 13, wherein a sound isolation within the sound conduit is greater than 40 Decibels.

15. The portable electronic device of claim 13, wherein the first end cap and the second end cap are proximately identically shaped.

16. The portable electronic device of claim 13, wherein the first end cap and the second end cap are bonded to the microphone and the interior surface of the housing, respectively, via a pressure sensitive adhesive.

17. The portable electronic device of claim 13, wherein the interior surface of the housing is curved.

18. The portable electronic device of claim 13, wherein the composite microphone boot is secured within the housing such that it is under a compressive force to increase a seal integrity between the composite microphone boot and the interior surface of the housing and to increase a seal integrity between the composite microphone boot and the microphone.

19. The portable electronic device of claim 18, wherein a pre-secured thickness of the center portion of the composite microphone boot is greater than a secured thickness of the center portion.

20. A method of manufacturing a portable computing device comprising:

determining dimensions and materials to use for a composite microphone boot;

forming the composite microphone boot according to the determined dimensions and the determined materials wherein the composite microphone boot comprises a center portion formed from a first material that separates a first end cap and a second cap such that the first end cap and the second end cap do not touch each other, the first end cap and the second end cap each formed from a second material that is harder than the first material;

attaching the formed composite microphone boot to a microphone; and attaching a microphone assembly including the composite microphone boot, the microphone and a circuit board to a housing of a portable computing device wherein the microphone assembly is attached such that the composite microphone boot is compressed to increase a sealing integrity of a first seal between the microphone boot and an interior surface of the housing and to increase a sealing integrity a second seal between the microphone boot and the microphone.

21. The method of claim 20, integrally forming the center portion, the first end cap and the second cap in a double shot molding process.

22. A non-transitory computer readable medium for storing computer code executed by a processor in a computer aided manufacturing process comprising:

computer code for forming a composite microphone boot wherein the composite microphone boot comprises a center portion formed from a first material that separates a first end cap and a second cap such that the first end cap and the second end cap do not touch each other, the first end cap and the second end cap each formed from a second material that is harder than the first material;

computer code for attaching the formed composite microphone boot to a microphone coupled to a printed circuit board; and computer code for attaching a microphone assembly including the composite microphone boot, the microphone and the printed circuit board to a housing of a portable computing device wherein the microphone assembly is attached such that the composite microphone boot is compressed to increase a sealing integrity of a first seal between the microphone boot and an interior surface of the housing and to increase a sealing integrity a second seal between the microphone boot and the microphone.

* * * * *